US006520194B1

(12) United States Patent
Frazier

(10) Patent No.: US 6,520,194 B1
(45) Date of Patent: Feb. 18, 2003

(54) HOLDER FOR CANES, UMBRELLAS AND THE LIKE

(76) Inventor: John K. Frazier, 3191 Stanwood La., Lafayette, CA (US) 94549

( * ) Notice: Subject to any disclaimer, the term of this patent is extended or adjusted under 35 U.S.C. 154(b) by 0 days.

(21) Appl. No.: 09/408,417

(22) Filed: Sep. 29, 1999

(51) Int. Cl.[7] ..... A45B 9/02
(52) U.S. Cl. ..... 135/76
(58) Field of Search ..... 135/76, 77, 82, 135/86, 44; 248/348.1

(56) References Cited

U.S. PATENT DOCUMENTS

| | | | | | |
|---|---|---|---|---|---|
| 702,492 | A | * | 6/1902 | Shaine | 135/44 |
| 790,642 | A | * | 5/1905 | Kuhn | 135/76 |
| 1,108,217 | A | * | 8/1914 | Ostman | 135/76 X |
| 3,467,117 | A | * | 9/1969 | Lucibello | 135/86 X |
| 3,763,872 | A | * | 10/1973 | Gooley | 135/77 X |
| 4,300,742 | A | | 11/1981 | Hunn | |
| 4,730,632 | A | | 3/1988 | Mace | |
| 4,834,127 | A | * | 5/1989 | Van Slice | 135/76 |
| 5,456,437 | A | | 10/1995 | Chander et al. | |
| 5,636,650 | A | * | 6/1997 | Kroeze | 135/77 X |
| 6,024,110 | A | * | 2/2000 | Renfro | 135/86 X |

FOREIGN PATENT DOCUMENTS

| | | | | |
|---|---|---|---|---|
| FR | 2616304 | * | 12/1988 | 135/76 |
| GB | 12069 | * | 8/1891 | 135/44 |

* cited by examiner

*Primary Examiner*—Jose V. Chen
(74) *Attorney, Agent, or Firm*—Jill L. Robinson

(57) ABSTRACT

A holder for canes, umbrellas and similar accessories comprising a tubular member to which a high-friction textured contact surface is attached is disclosed. When the holder is attached to the accessory the user may hang the accessory on a table or other horizontal surface with a reduced possibility that the accessory will slip.

29 Claims, 2 Drawing Sheets

HOLDER FOR CANES, UMBRELLAS AND THE LIKE

BACKGROUND OF THE INVENTION

Almost all individuals carry a cane, umbrella or similar accessory at some time during their lives. One problem that often arises is what to do with the accessory when it is not being carried or is otherwise not in use. If placed on the floor, such an accessory may become a hazard, and may be difficult for individuals with limited mobility to retrieve. While it is sometimes possible to place the accessory upright in a dedicated holding device, such as an umbrella stand or in a cane holder such as is shown in U.S. Pat. No. 4,605,190, such devices are not portable and are thus often impractical, particularly for accessories such as canes that need to remain near the owner when not in use. Often individuals will attempt to simply hang the accessory by its handle on the edge of a table or counter, where it is easily reachable. Unfortunately, since the handle is usually not designed for this use, an accessory stored in this way will frequently fall to the floor. Although portable devices exist that are designed to keep a cane on a table or counter, such as U.S. Pat. No. 5,456,437, a simpler and less expensive device is desirable.

SUMMARY OF THE INVENTION

In view of the foregoing, it is an object of the present invention to provide a device which will reduce the possibility that an accessory with a longitudinal member, such as a cane or umbrella, will fall when it is hung on a table, counter or other elevated, horizontal surface. It is a further object of the present invention to provide a device that can be easily attached to a cane, umbrella or a similar accessory. It is a further object of the invention to provide a device that is easily and inexpensively manufactured, The current invention comprises a tubular member that fits onto a cane, umbrella or similar accessory on the handle or otherwise on or near one end of the longitudinal member of the accessory. The tubular member has an internal size and shape of approximately the same external size and shape as the handle or longitudinal member of the accessory and is constructed of materials with sufficient flexibility or resilience to fit over and grip the handle or longitudinal member. The tubular member may be split in order to allow the tubular member to fit over a larger range of sizes of handles or longitudinal members. A contact surface with a high friction texture that restricts the movement of the handle on a table or other horizontal surface is attached to or is of integral, unitary construction with the tubular member. The contact surface is positioned such that, when the holder is attached to the accessory, the contact surface can rest on a horizontal surface allowing the accessory to be hung from the horizontal surface with the longitudinal member positioned and supported in an approximately vertical orientation.

DETAILED DESCRIPTION OF THE DRAWINGS

Figure 1:
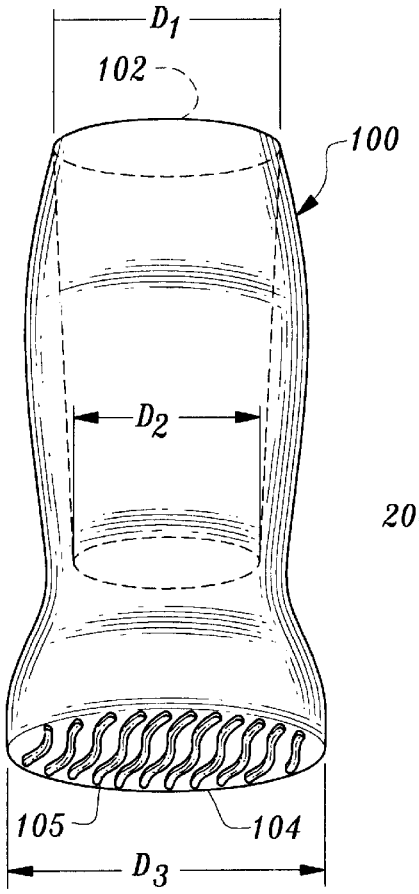
FIG. 1 shows a first embodiment of the invention designed for attachment to a "standard" curved of an umbrella, cane or similar accessory.
Figure 2:
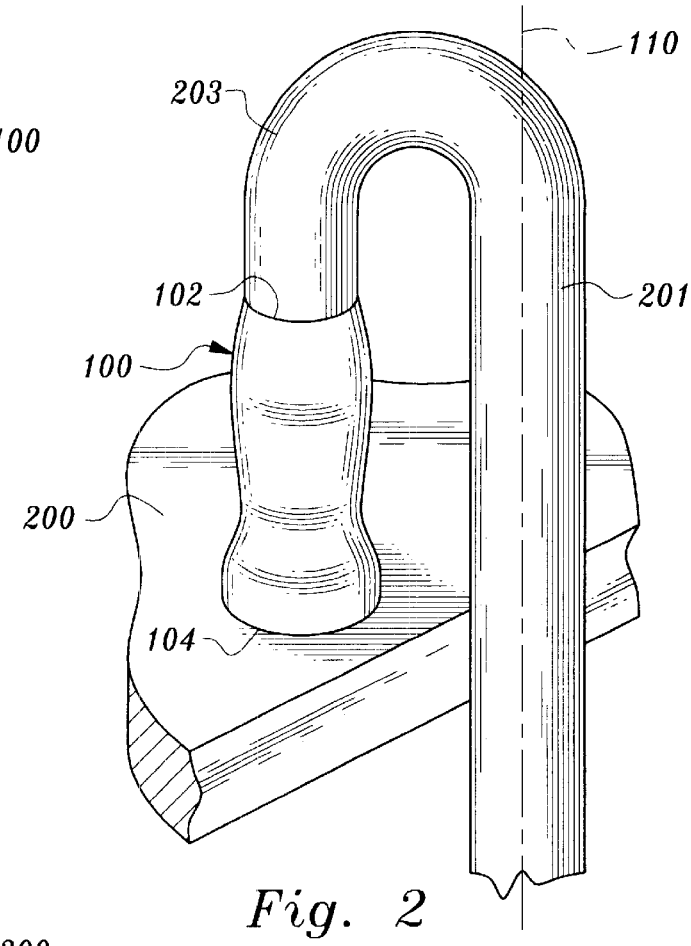
FIG. 2 shows the first embodiment of the invention attached to an accessory handle and in use.
Figure 7:
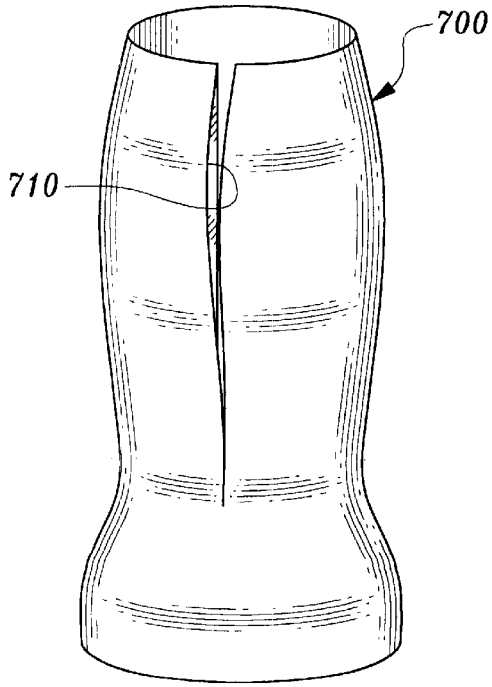
FIG. 7 shows an optional split in the tubular member of the invention which may be appropriate in certain embodiments of the invention.

The embodiment of the invention shown in FIGS. 1 and 2 may be attached to a "standard" curved accessory handle, such as is often found on a cane or umbrella. The holder comprises a tubular member 100 having a first, open end 102 and a second, closed end 104. The portion of the tubular member 100 that is near the first end 102 of the tubular member 100 is constructed of flexible or resilient materials, such as rubber or a resilient plastic, and has a diameter that allows the end of the handle 203, or the end of the longitudinal member 201, to be inserted into the tubular member 100, and frictionally held in place. Although it is necessary that the first end 102 be at least partly constructed of flexible material in order to properly retain the holder on the accessory, for ease of manufacture the entire holder may be formed of the same flexible material. As shown in FIG. 7, it is also possible to construct the tubular member 700, with a split 710 to allow the tubular member 700 to fit over and be retained on a larger handle. The internal diameter D2 of the tubular member may decrease slightly toward the second end 104 to improve retention of the tubular member 100 on the handle 203.

The second end 104 of the tubular member 100 is closed. A contact surface 105 is positioned on the second end 104 of the tubular member 100. The contact surface 105 may be constructed as a part of, and unitary with, the tubular member or as separate surface which is subsequently attached to the second end 104 of the tubular member. The contact surface is positioned such that when the tubular member 100 is properly attached on or near the appropriate end of the longitudinal member of the accessory, the longitudinal member 201 may be positioned and supported in an approximately vertical orientation when the contact surface 105 is resting near the edge of a horizontal surface 200, such as a table, with most of the longitudinal member suspended below the level of the horizontal surface.

The contact surface 105 is composed of a high-friction texture which reduces the movement of the contact surface on the horizontal surface. The contact surface 105 is preferably, although not necessarily, planar, to increase the contact area between the contact surface 105 and the horizontal surface 200. The contact surface 105 may be constructed to be of greater diameter D3 than the external diameter of the tubular member D1, but may also be of lesser diameter and/or may be of a different shape than the tubular member 100.

Figure 3:
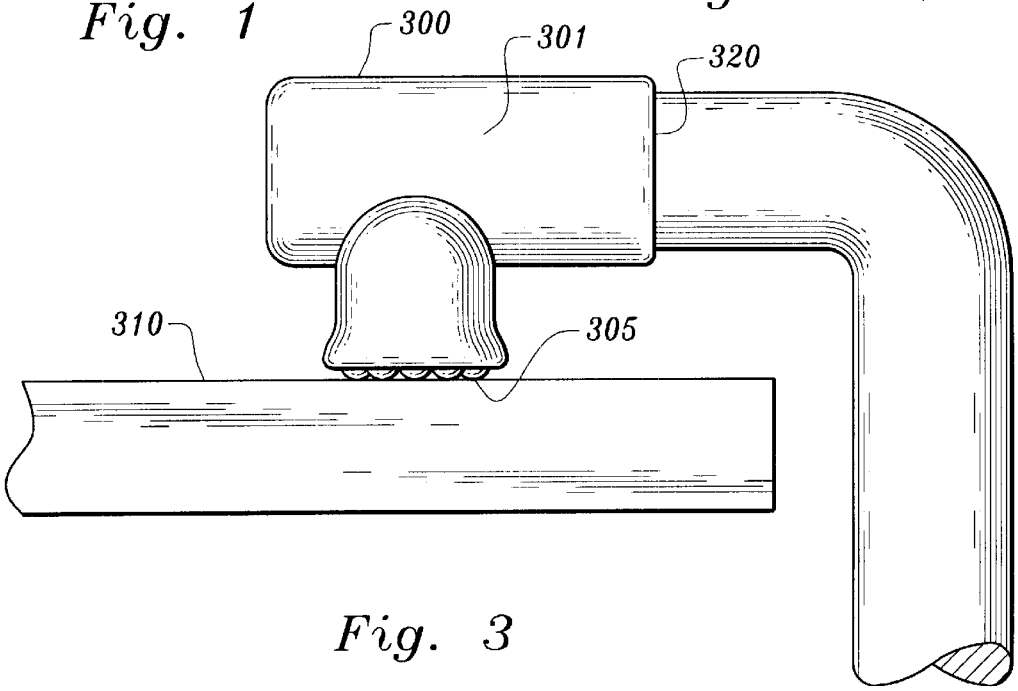
FIG. 3 shows a second embodiment of the invention designed for attachment to an alternative accessory handle.

FIG. 3 shows an alternative embodiment of the invention intended for use with a cane or similar accessory with a rectangular handle. Such handles usually project at approximately 90 degrees from the central axis of the longitudinal member of the accessory. To accommodate this accessory design, the contact surface 305 is positioned on the external wall 301 of the tubular member 300 in an orientation that will allow proper positioning of the accessory when in use as described in the text associated with FIGS. 1 and 2. In the embodiment shown, the contact surface 305 is placed so that the plane 310 defined by the contact surface 305 is perpendicular to the plane 320 defined by the opening of the tubular member 300.

As would be evident to persons of ordinary skill in the art, the contact surfaces 105, 305 can be positioned at locations on the tubular member 100, 300 other than those shown to accommodate other accessory designs, but must be placed so that the longitudinal member of the accessory can be properly positioned when the holder is in use.

In all embodiments, the contact surface 105, 305 must be positioned on the tubular member 100 so that when the holder is in use at least a portion of the contact surface 105, 305 is separated from the central axis 110 defined by the longitudinal member of the accessory. This separation must be sufficient to allow the contact surface 105, 305 to be placed near the edge of a horizontal surface and allow the accessory to hang, in balance, in a substantially vertical orientation below the horizontal surface. In the embodiments shown in FIGS. 1, 2 and 3 the separation is created by the accessory itself when the tubular member 100 is attached to the handle of the accessory; however, persons of ordinary skill in the art will appreciate that the tubular member could be modified to create the necessary separation.

Figure 4:
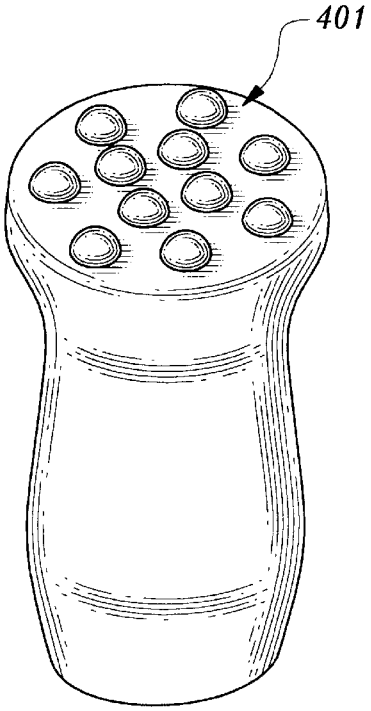
FIG. 4 shows a first contact surface texture for use in any embodiment of the invention.
Figure 5:
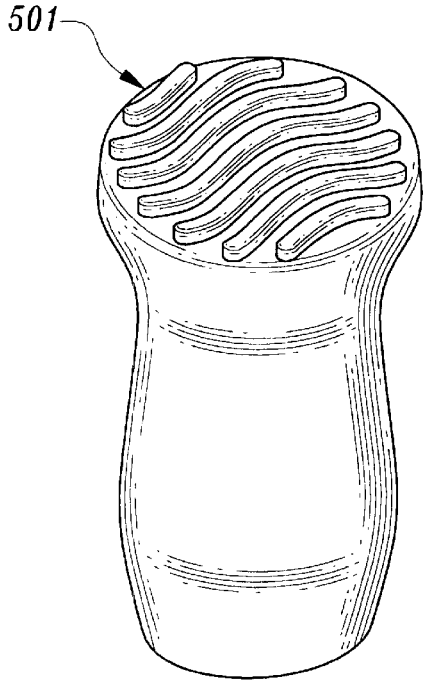
FIG. 5 shows a second contact surface texture for use in any embodiment of the invention.
Figure 6:
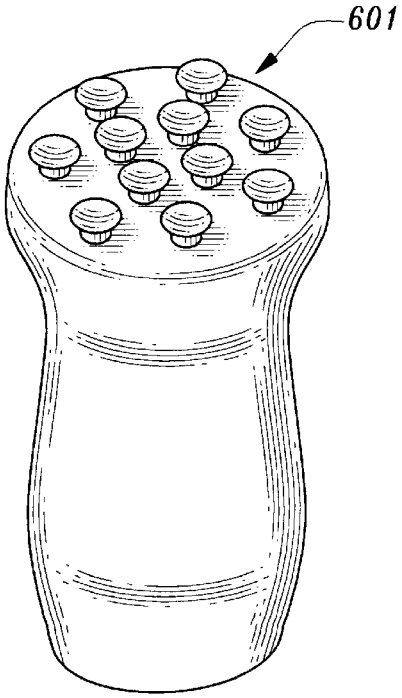
FIG. 6 shows a third contact surface texture for use in any embodiment of the invention.

The contact surface 105, 305 must be of a high-friction texture, that is, a texture that would tend to inhibit the movement of the contact surface 105, 305 relative to the horizontal surface on which it is placed. FIGS. 4, 5 and 6 show examples of high friction textures that could be used on the contact surfaces of any embodiment of the invention. FIG. 4 shows a high friction texture comprising a plurality of raised hemispherical dots or bumps 401. Although shown as hemispherical, a person of ordinary skill in the art will appreciate that alternative shapes are possible. FIG. 5 shows a high friction texture comprising a plurality of raised wavy lines 501, although raised straight lines could also be used. The textures shown in FIGS. 4 and 5 are preferably formed of materials such as, but not limited to, rubber (natural or synthetic) and resilient plastics, which increase the friction between the horizontal surface and the contact surface and which would be unlikely to damage the horizontal surface. Finally, FIG. 6 shows a high friction texture comprising a plurality of suction cups 601. Persons of ordinary skill in the art will appreciate that even a single suction cup could be used and that the suction cups may be formed of rubber, plastic or similar material. Other textures are, of course, possible and the high friction texture could also be created by the use of a material that is, in itself, "non-skid".

With reference to FIG. 7, a tubular member 700 is shown with a split 710 which would increase the range of sizes of handles and/or longitudinal members on which the tubular member 700 would fit.

While preferred embodiments of the present invention are described above, it is contemplated that various modifications may be made without departing from the spirit and scope of the invention.

What is claimed is:

1. An accessory, said accessory intended to be carried by an individual comprising:

a longitudinal member of length L defining a center axis A, said longitudinal member having a first end and a second end;

a tubular member, said tubular member defining an opening, wherein the tubular member near said opening is flexible and the opening is adapted to receive and attach to the first end of the longitudinal member;

a contact surface attached to the tubular member, said contact surface having a high-friction texture, wherein the high friction texture comprises a plurality of raised hemispherical bumps, and such that when said tubular member is attached to the longitudinal member at least a portion of the contact surface is positioned apart from and approximately perpendicular to the axis A, and wherein the contact surface is adapted for placement on a horizontal surface having an edge and being elevated to a height greater than L, near the edge of the horizontal surface, whereby the accessory is supported by the tubular member and the second end of the longitudinal member is below the edge of the horizontal surface.

2. The device of claim 1, wherein the contact surface is of unitary construction with the tubular member.

3. An accessory, said accessory intended to be carried by an individual comprising:

a longitudinal member of length L defining a center axis A, said longitudinal member having a first end and a second end;

a tubular member, said tubular member defining an opening, wherein the tubular member near said opening is flexible and the opening is adapted to receive and attach to the first end of the longitudinal member;

a contact surface attached to the tubular member, said contact surface having a high-friction texture, wherein the high friction texture comprises at least one suction cup, and such that when said tubular member is attached to the longitudinal member at least a portion of the contact surface is positioned apart from and approximately perpendicular to the axis A, and wherein the contact surface is adapted for placement on a horizontal surface having an edge and being elevated to a height greater than L, near the edge of the horizontal surface, whereby the accessory is supported by the tubular member and the second end of the longitudinal member is below the edge of the horizontal surface.

4. The device of claim 3, wherein the high friction texture comprises a plurality of suction cups.

5. The device of claim 3, wherein the contact surface is of unitary construction with the tubular member.

6. An accessory, said accessory intended to be carried by an individual comprising:

a longitudinal member of length L defining a center axis A, said longitudinal member having a first end and a second end;

a tubular member, said tubular member defining an opening, wherein the tubular member near said opening is flexible and the opening is adapted to receive and attach to the first end of the longitudinal member;

a contact surface attached to the tubular member, said contact surface having a high-friction texture, wherein the high friction texture comprises a plurality of raised lines, and such that when said tubular member is attached to the longitudinal member at least a portion of the contact surface is positioned apart from and approximately perpendicular to the axis A, and wherein the contact surface is adapted for placement on a horizontal surface having an edge and being elevated to a height greater than L, near the edge of the horizontal surface, whereby the accessory is supported by the tubular member and the second end of the longitudinal member is below the edge of the horizontal surface.

7. The device of claim 6, wherein the contact surface is of unitary construction with the tubular member.

8. An accessory intended to be carried by an individual comprising:

a longitudinal member defining a central axis and forming a curved handle separated from the central axis;

a tubular member, said tubular member having a first end and a second end, said first end of flexible material defining an opening for receiving the first end of the longitudinal member, whereby the tubular member is attached to the handle of the accessory; and wherein the second end of the tubular member comprises a contact surface with a high-friction texture, wherein the high friction texture comprises a plurality of raised hemispherical bumps.

9. The device of claim 8, wherein the contact surface is of unitary construction with the tubular member.

10. An accessory intended to be carried by an individual comprising:

a longitudinal member defining a central axis and forming a curved handle separated from the central axis;

a tubular member, said tubular member having a first end and a second end, said first end of flexible material defining an opening for receiving the first end of the longitudinal member, whereby the tubular member is attached to the handle of the accessory; and wherein the second end of the tubular member comprises a contact surface with a high-friction texture, wherein the high friction texture comprises at least one suction cup.

11. The device of claim 10, wherein the high friction texture comprises a plurality of suction cups.

12. The device of claim 10, wherein the contact surface is of unitary construction with the tubular member.

13. An accessory intended to be carried by an individual comprising:

a longitudinal member defining a central axis and forming a curved handle separated from the central axis;

a tubular member, said tubular member having a first end and a second end, said first end of flexible material defining an opening for receiving the first end of the longitudinal member, whereby the tubular member is attached to the handle of the accessory; and wherein the second end of the tubular member comprises a contact surface with a high-friction texture, wherein the high friction texture comprises a plurality of raised lines.

14. The device of claim 13, wherein the contact surface is of unitary construction with the tubular member.

15. An accessory intended to be carried by an individual comprising:

a longitudinal member defining a central axis and forming a handle extending at approximately a right angle from the central axis;

a tubular member, said tubular member having a first end and a second end, said first end of flexible material defining an opening for receiving and holding the handle and further defining a first plane;

a contact surface with a high-friction texture defining a second plane, attached to the external surface of the tubular member, and positioned such that the first plane is approximately perpendicular to the second plane, and separated from the central axis of the longitudinal member when the handle is held in the opening of the tubular member said contact surface adapted for placement on an elevated horizontal surface having a height greater than L, near an edge of the horizontal surface, whereby the accessory is supported by the tubular member and the second end of the longitudinal member is below the edge of the horizontal surface, wherein the high friction texture comprises a plurality of raised hemispherical bumps.

16. The device of claim 15, wherein the contact surface is of unitary construction with the tubular member.

17. An accessory intended to be carried by an individual comprising:

a longitudinal member defining a central axis and forming a handle extending at approximately a right angle from the central axis;

a tubular member, said tubular member having a first end and a second end, said first end of flexible material defining an opening for receiving and holding the handle and further defining a first plane;

a contact surface with a high-friction texture defining a second plane, attached to the external surface of the tubular member, and positioned such that the first plane is approximately perpendicular to the second plane, and separated from the central axis of the longitudinal member when the handle is held in the opening of the tubular member said contact surface adapted for placement on an elevated horizontal surface having a height greater than L, near an edge of the horizontal surface, whereby the accessory is supported by the tubular member and the second end of the longitudinal member is below the edge of the horizontal surface, wherein the high friction texture comprises at least one suction cup.

18. The device of claim 17, wherein the contact surface is of unitary construction with the tubular member.

19. An accessory intended to be carried by an individual comprising:

a longitudinal member defining a central axis and forming a handle extending at approximately a right angle from the central axis;

a tubular member, said tubular member having a first end and a second end, said first end of flexible material defining an opening for receiving and holding the handle and further defining a first plane;

a contact surface with a high-friction texture defining a second plane, attached to the external surface of the tubular member, and positioned such that the first plane is approximately perpendicular to the second plane, and separated from the central axis of the longitudinal member when the handle is held in the opening of the tubular member said contact surface adapted for placement on an elevated horizontal surface having a height greater than L, near an edge of the horizontal surface, whereby the accessory is supported by the tubular member and the second end of the longitudinal member is below the edge of the horizontal surface. wherein the high friction texture comprises a plurality of raised lines.

20. The device of claim 19, wherein the contact surface is of unitary construction with the tubular member.

21. An accessory, said accessory intended to be carried by an individual comprising:

a longitudinal member of length L defining a center axis A, said longitudinal member having a first end and a second end;

a tubular member, said tubular member defining an opening, wherein the tubular member near said opening is flexible and the opening is adapted to receive and attach to the first end of the longitudinal member;

a contact surface attached to the tubular member, said contact surface having a high-friction texture, and wherein the entire contact surface is substantially planar, and such that when said tubular member is attached to the longitudinal member at least a portion of the contact surface is positioned apart from and approximately perpendicular to the axis A, and wherein the contact surface is adapted for placement on a horizontal surface having an edge and being elevated to a height greater than L, near the edge of the horizontal surface, whereby the accessory is supported by the tubular member and the second end of the longitudinal member is below the edge of the horizontal surface.

22. The device of claim 21, wherein the contact surface is of unitary construction with the tubular member.

23. The device of claim 21 wherein the tubular member has a first end and a second end, such that the opening defines a first plane and is at the first end of the tubular member and the contact surface defines a second plane and is positioned on the tubular member such that the first plane is perpendicular to the second plane.

24. The device of claim 23, wherein the contact surface is of unitary construction with the tubular member.

25. An accessory intended to be carried by an individual comprising:

a longitudinal member defining a central axis and forming a curved handle separated from the central axis;

a tubular member, said tubular member having a first end and a second end, said first end of flexible material defining an opening for receiving the first end of the longitudinal member, whereby the tubular member is attached to the handle of the accessory; and wherein the second end of the tubular member comprises a contact surface with a high-friction texture wherein the entire contact surface is substantially planar.

26. The device of claim 25, wherein the contact surface is of unitary construction with the tubular member.

27. An accessory intended to be carried by an individual comprising:

a longitudinal member defining a central axis and forming a handle extending at approximately a right angle from the central axis;

a tubular member, said tubular member having a first end and a second end, said first end of flexible material defining an opening for receiving and holding the handle and further defining a first plane;

a contact surface with a high-friction texture wherein the entire contact surface is substantially planar and defines a second plane, attached to the external surface of the tubular member, and positioned such that the first plane is approximately perpendicular to the second plane, and separated from the central axis of the longitudinal member when the handle is held in the opening of the tubular member said contact surface adapted for placement on an elevated horizontal surface having a height greater than L, near an edge of the horizontal surface, whereby the accessory is supported by the tubular member and the second end of the longitudinal member is below the edge of the horizontal surface.

28. The device of claim 27, wherein the contact surface is of unitary construction with the tubular member.

29. A holder comprising:

a tubular member, said tubular member defining an opening, wherein the tubular member near said opening is flexible;

a contact surface attached to the tubular member, said contact surface having a high-friction texture, wherein the entire contact surface is substantially planar, said opening adapted to receive and removably attach to a handle of an accessory that comprises a longitudinal member of length L defining a center axis A having a first end and a second end, wherein said first end defines the handle and wherein a portion of said handle is separated from the central axis A, said contact surface positioned on the tubular member such that when the tubular member is attached to the handle, at least a portion of the contact surface is positioned apart from and approximately perpendicular to the axis A, and is adapted for placement on an edge of a horizontal surface elevated to a height greater than L, whereby the accessory is supported by the tubular member and the second end of the longitudinal member is below the edge of the horizontal surface.

* * * * *